United States Patent [19]

Bruml

[11] 4,170,327

[45] Oct. 9, 1979

[54] HINGED COVER CARTON

[76] Inventor: Norman A. Bruml, 201 Donnybrook Rd., Montvale, N.J. 07645

[21] Appl. No.: 944,512

[22] Filed: Sep. 20, 1978

[51] Int. Cl.[2] ..... B65D 5/66

[52] U.S. Cl. ..... 229/44 R; 206/45.13

[58] Field of Search ..... 229/44, 34 HW; 206/45.13

[56] References Cited

U.S. PATENT DOCUMENTS

| | | | |
|---|---|---|---|
| 1,007,113 | 10/1911 | Kazian | 206/251 |
| 2,647,624 | 8/1953 | Sedgwick | 206/45.13 |
| 2,675,911 | 4/1954 | Thurston | 206/45.13 |
| 2,783,876 | 3/1957 | Williamson | 206/45.13 |
| 2,951,583 | 9/1960 | Sanford | 206/45.13 |
| 2,990,056 | 6/1961 | Gillam | 206/45.13 |
| 3,100,074 | 8/1963 | Beck | 229/44 R |
| 3,232,518 | 1/1966 | Williamson | 229/44 R |
| 3,900,100 | 8/1975 | Girman | 206/45.13 |

*Primary Examiner*—Davis T. Moorhead
*Attorney, Agent, or Firm*—David A. Jackson

[57] ABSTRACT

A hinged cover carton formed from a sheet blank section comprising: a cover means, the cover means comprising a top panel and a side wall integrally attached thereto, the side wall extending the entire perimeter of the top panel. The hinged cover carton also comprises a base assembly including a base section having a raised, beveled area along a portion thereof, the base section being hingably attached to the side wall of the cover means. Additionally, a guide means is attached along a portion thereof to the beveled area, and attached along an opposing portion thereof to the inside of the cover means, wherein the guide means is adapted to alternatively urge the cover means towards a closed and opened position and retain the cover means in a plurality of partially opened positions when said cover means is at an appropriate angular position with respect to the base assembly.

13 Claims, 7 Drawing Figures

HINGED COVER CARTON

BACKGROUND OF THE INVENTION

This invention relates to a hinged cover carton. More particularly, this invention relates to a hinged cover carton wherein the hinge is provided with spring biased actuation to both the opened and closed position.

The utilization of cartons manufactured from cut-out blanks is well-known in the art. Such blanks are cut out with specific dimensions and configurations, and with perforated and scored lines such that when folded in the appropriate direction, a desired carton is obtained. These cartons are numerous and varied. For example, U.S. Pat. No. 3,232,518 discloses a hinged cover carton formed from a sheet blank, as shown in FIG. 1.

There is a need, however, in the art to provide a hinged carton having some means to automatically open and close the cover of the carton when the cover is near that respective position. Additionally, there is a need to achieve this latter result by utilizing a sheet blank, e.g., without an unduly expensive or bulky mechanism. Examples of analagous prior art in which an article support pops out upon opening of the carton can be found in U.S. Pat. Nos. 1,007,113 and 2,647,624. However, these latter patents do not utilize any means to open and close the carton cover when the cover is near these positions.

From the above, it can be seen that hinged cartons known to date do not provide any suitable means for opening and closing the cover of the carton when the cover is near the opened or closed positions. Accordingly, it is believed that the present invention solves the aforementioned problems.

SUMMARY OF THE INVENTION

In accordance with the present invention, a hinged cover carton formed from a sheet blank section is provided, comprising a cover means, the cover means comprising a top panel and a side wall integrally attached thereto, the side wall extending the entire perimeter of the top panel. The hinged cover carton also comprises a base assembly including a base section having a raised, beveled area along a portion thereof, the base section being hingably attached to the side wall of the cover means. Additionally, a guide means is attached along a portion thereof to the inside of the cover means, wherein the guide means acts to alternatively urge the cover means towards a closed and opened position and retain the cover means in a plurality of partially opened positions when the cover means is at an appropriate angular position with respect to the base assembly.

The cover means and guide means of the hinged cover carton is formed from a single sheet of blank section. The blank section comprises a top panel, opposing side panels integrally attached to either side of the top panels, a back panel integrally attached to a free side of the top panel, a front panel integrally attached to the top panel at a side opposite the back panel, locking sections attached to the front and back panels and a guide means integrally attached to either the back panel or the front panel, the guide means preferably being of a generally rectangular configuration.

Accordingly, it is a principal object of the present invention to provide a hinged cover carton in which a guide means urges the cover towards a closed and opened position and retains the cover in a plurality of partially opened positions when the cover is at an appropriate angular position with respect to the base assembly.

It is a further object of the present invention to provide a hinged cover carton in which the carton may be formed from a sheet blank section.

It is a still further object of the present invention to provide a hinged cover carton in which a simple, inexpensive and efficient closing and opening means is provided for the hinged cover carton.

Further objects and advantages will become apparent from a consideration of the description which follows with reference to the accompanying drawings.

DESCRIPTION OF THE PREFERRED EMBODIMENTS

In accordance with the present invention, the foregoing objects and advantages are readily obtained.

Figure 1:
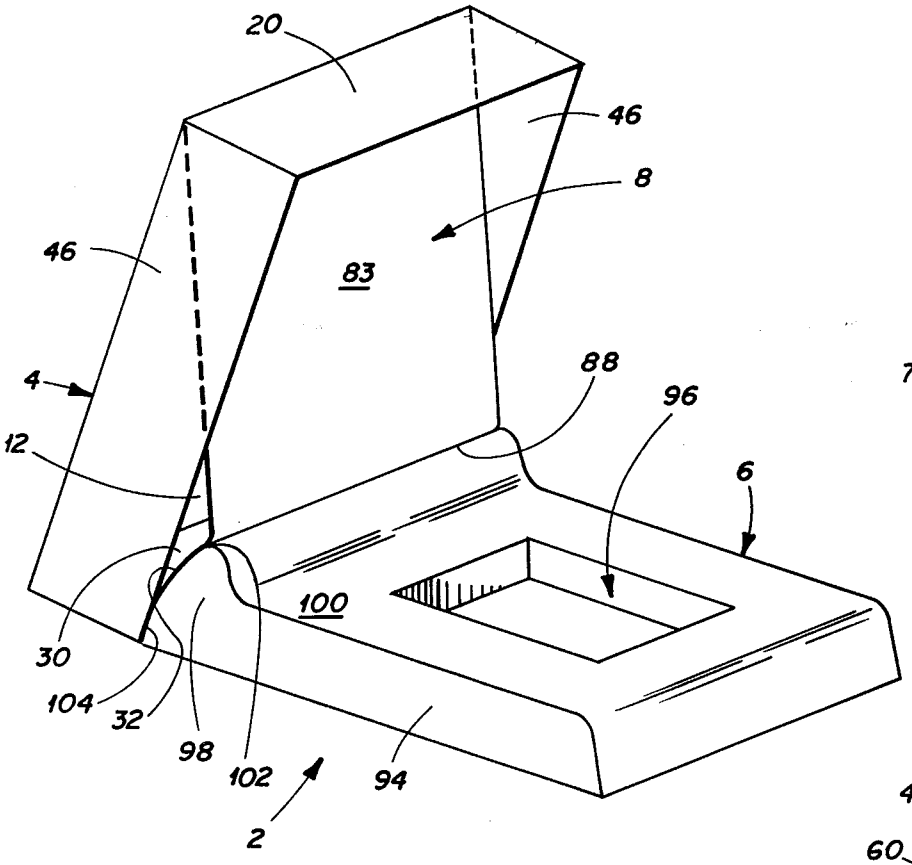
FIG. 1 is a perspective view of one embodiment of the hinged cover carton of the present invention.

Referring to the drawings, wherein like numerals represent like parts, a hinged cover carton 2 is provided in FIG. 1 having a cover means 4, a base assembly means 6 hingably attached to the cover means 4, and a guide means 8 attached to the base assembly means 6 and the cover means 4, wherein the guide means 8 acts as a closing and opening means for the cover means 4 with respect to the base means 6.

Figure 2:
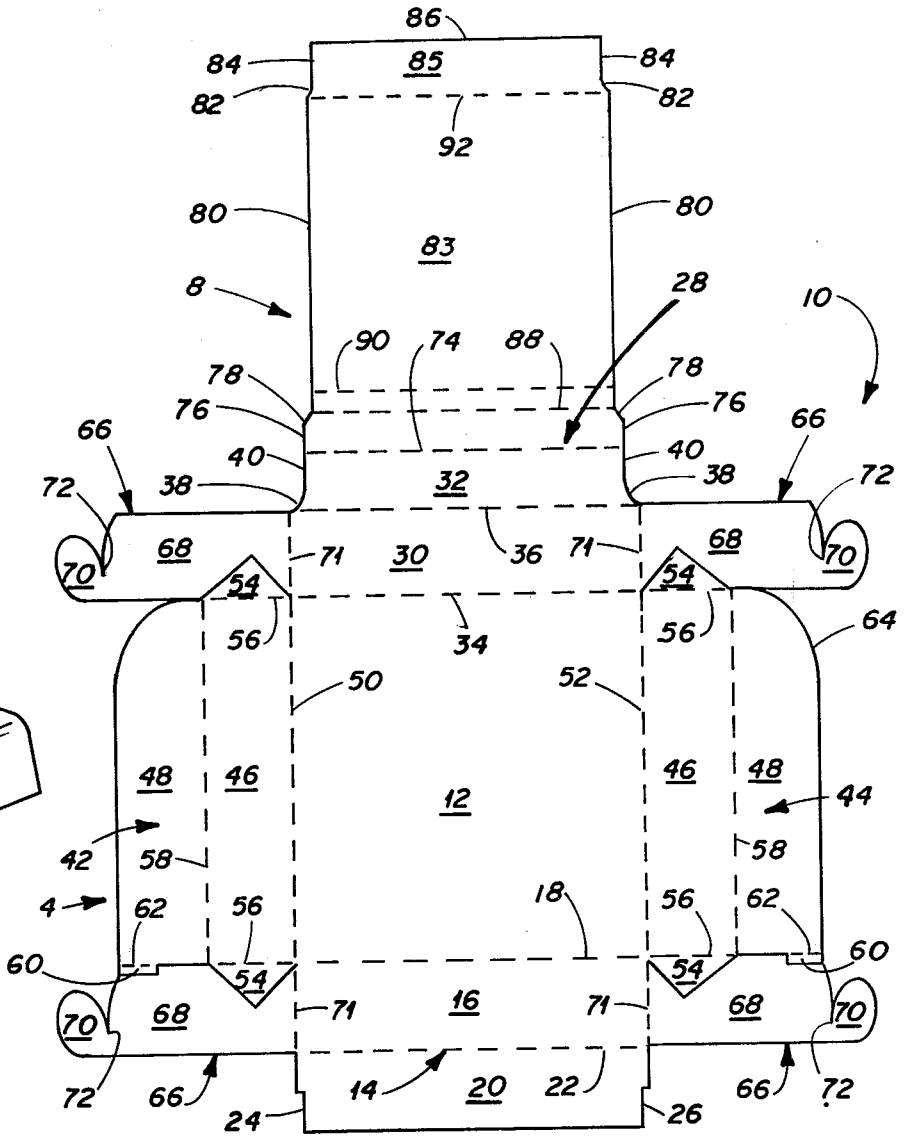
FIG. 2 is a top, plan view of the sheet blank of the embodiment of the present invention of FIG. 1.

Referring to FIG. 2, a sheet blank 10 is provided with appropriate score lines and perforations such that when folded in the appropriate manner, an integral cover 4 and guide means 8 is formed. The cover section 4 includes a top panel 12 of a generally rectangular configuration. Integral with top panel 12 is front panel 14 including outside front panel 16 of a rectangular configuration having an equal dimension to top panel 12 at the junction thereof, the joining line constituting a working score line 18. Integrally attached to the opposite side of front outside panel 16 constituting working score line 18 is inside front panel 20 having the same dimension as outside front panel 16 at the line joining the two panels 16 and 20, hereinafter known as inside front panel working score line 22. Inside front panel 20 is of a generally rectangular configuration having locking notches 24 and 26 on both sides of inside front panel 20 along the side opposite inside front panel working score line 22, to be later discussed.

Integrally attached to top panel 12 opposite the side constituting working score line 18 is back panel 28 including outside back panel 30 integrally attached to top panel 12 opposite the side constituting working score line 18 and of the same dimension at that juncture. Outside back panel 30 is of a generally rectangular configuration and is joined at a side of top panel 12 constituting outside back panel working score line 34. Outside back panel 30 has the same dimension at working score line 34 as the same side of top panel 12. Integrally attached to outside back panel 30 at the side of back panel 30 opposite working score line 34 is inside back panel 32 of a generally rectangular configuration. Inside back panel 32 has an equal dimension to outside back panel 30 at the juncture thereof, hereinafter constituting inside back panel working score line 36. From working score line 36, the sides of inside back panel 32 flare inwardly in a tapered manner indicated at 38, whereupon the sides 40 of inside back panel 32 are angled perpendicular to working score line 36 to constitute a substantially rectangular configuration.

Integrally attached to the remaining sides of top panel 12 are side panels 42 and 44. Each side panel comprises an outside side panel 46 and an inside side panel 48. Each outside side panel 46 is of a generally rectangular configuration, the side of rectangular outside side panel 46 being of equal dimension to the juncture side of top panel 12, hereafter known as outside side panel working score lines 50 and 52, respectively. Additionally, on both sides of outside panels 46, perpendicular to working score lines 50 and 52, are tabs 54, preferably of a triangular configuration with one of its sides integral and of equal dimension to the opposite sides of outside side panels 46 that are perpendicular to working score lines 50 and 52, hereafter known as side panel tab working score lines 56. Integrally attached to outside side panels 46 on the side opposite working score lines 50 and 52 are inside side panels 48 of a substantially rectangular configuration, inside side panels 48 having the side integral with outside side panel 46 of the same dimension thereof, that side being known as inside side panel working score line 58. As shown in FIG. 2, one side of inside side panels 48 comprises a locking tab 60 of a generally rectangular configuration and being integral with said panels 48. Locking tabs 60 are integral with side panels 48 along a side perpendicular to working lines 58 and extend from the side opposite working lines 58 along the aforementioned side of inside side panels 48, but not extending to working lines 58. The line of integral attachment between locking tabs 60 and inside side panels 48 is known as locking tab working score lines 62. Along the sides of inside side panel 48 opposite locking tabs 60 is a curved corner section 64 in which the sides of inside side panel 48 opposite locking tabs 60 and the sides of inside side panel 48 opposite working score lines 58, meet.

Integrally attached to the free opposing ends of outside back panel 30 and outside front panel 16 are slit-locking sections 66 having a first generally rectangular section 68 and a second tab section 70. Generally rectangular section 68 is integrally attached at one side and equal in dimension to the free opposing ends of outside back panel 30 and outside front panel 16, respectively, the free ends of these respective panels being known as slit-locking section working score lines 71. Additionally, rectangular sections 68 comprise a triangular cut-out section defined by and abutting side panel tabs 54 of outside side panels 46. Also, rectangular sections 68 of outside front panel 16 comprise a rectangular cut-out section defined by and abutting locking tabs 60 of inside side panels 48. Moreover, rectangular sections 68 of slit-locking sections 66 extend approximately and in abutting relation thereto the width of side panels 42 and 44, respectively, from working score lines 50 and 52 to the side opposite the working score lines 58 of inside side panels 48. Integrally attached to rectangular sections 68 at the side opposite working score lines 71 along a part of that side closest to inside front panel 20 are tab sections 70 which abut rectangular sections 68 along the side opposite working score lines 71 from the uppermost point of attachment thereto for a distance not reaching to cut-out sections corresponding to locking tabs 60. In this manner, a slit 72 is provided in each of the slit-locking sections 66.

Integrally attached to inside back panel 32 at the side opposite working score line 36 is guide means 8 of a generally rectangular configuration having a dimension on the side of attachment, hereinafter known as perforation 74, equal to that of the side of inside back panel 32 opposite working score line 36. Guide means 8 thereafter extends from perforation 74 at both sides and at right angles thereof along side sections 76, whereupon side sections 76 end in a tapered neck section 78. Guide means 8 thereafter extends from the ends of inwardly tapered sections 78 along side walls 80 which are parallel to side sections 76, whereupon side sections 80 slightly taper inwardly at tapered neck sections 82. Guide means 8 then extends along side walls 84 from the ends of tapered neck sections 82 to the end of guide means 8, the end wall 86 of guide means 8 being parallel to working score lines 34 and 36. Guide means 8 also includes working score line 88 extending from and connecting the ends of tapered neck sections 78, working score line 90 parallel to working score line 88 and slightly above the latter line, and working score line 92 connecting the ends of side walls 80 near tapered sections 82.

In this manner, a cover means 4 and guide means 8 integral with cover means 4 can be formed from sheet blank 10 in FIG. 2. This latter result may be achieved by the following steps. Back panel 28 and front panel 14 are folded toward each other and at 90° to top panel 12 by bending these panels along working score lines 34 and 18, respectively. Slit-locking sections 66 are then folded along working score lines 71 at right angles to outside back panel 30 and outside front panel 16 such that the slit-locking sections 66 on the same side of cover means 10, one slit-locking section 66 being on front panel 14 and the other being on back panel 28, are disposed toward each other, whereupon slits 72 of the respective slit-locking sections 66 are inserted within one another to lock front panel 14 and back panel 28 in an upright position. Side panel tabs 54 are then folded along side panel tab working score lines 56 so as to lie flush against outside side panels 46 of panels 42 and 44. Additionally, these side panel tabs 54 are preferably glued to the aforementioned position on the inside of outside side panels 46. Next, side panels 42 and 44 are folded along side panel working score lines 50 and 52, respectively, such that side panels 42 and 44 are at right angles to top panel 12 and flush against slit-locking sections 66 as previously described. Additionally, outside side panels 46 are preferably glued to the outside of slit-locking sections 66. Inside side panels 48 are then folded along inside side panel working score lines 58 such that inside side panels 48 are flush against the inside of slit-locking section 66, and are preferably glued thereon. Also, locking tabs 60 are folded at 90° to inside side panels 48 so as to be flush against the inside of outside rear section 30. Guide means 8 is then folded along perforation 74 so as to be directly above top panel 12. Guide means 8 is also folded along working score lines 88 and 90 and folded along working score line 92 at substantially right angles to side walls 80 such that end section 85 is flush against the inside of outside front panel 16 and working score line 92 is substantially flush against working score line 18. Preferably, end section 85 is glued to the inside of ouside front section 16, thus locking locking tabs 60 therebetween. Next, inside front panel 20 is folded about working score line 22 such that it is flush against the opposite side of end section 85 of guide means 8, and is preferably glued thereon. In this manner, a cover means 4 and a guide means 8 integral therewith is formed as shown in FIG. 1.

Figure 3:
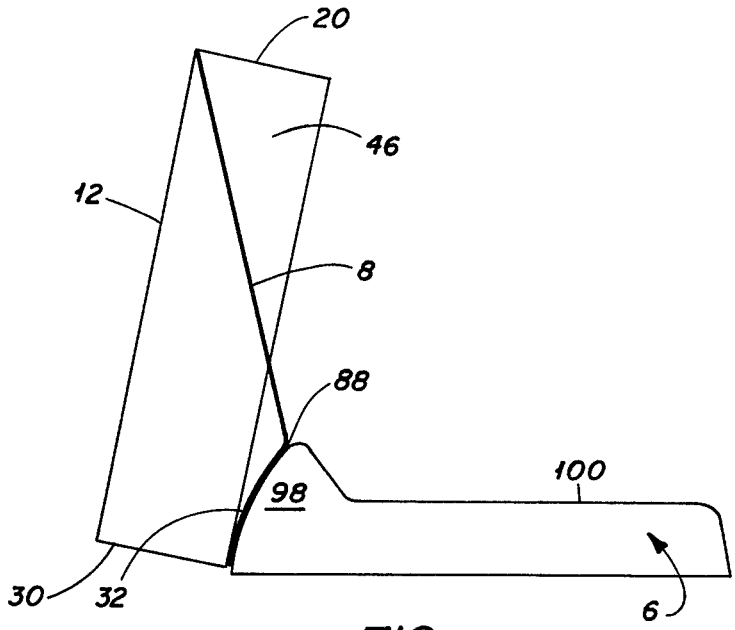
FIG. 3 is a side, cross-sectional view of the invention of FIG. 1 in its open position.
Figure 6:
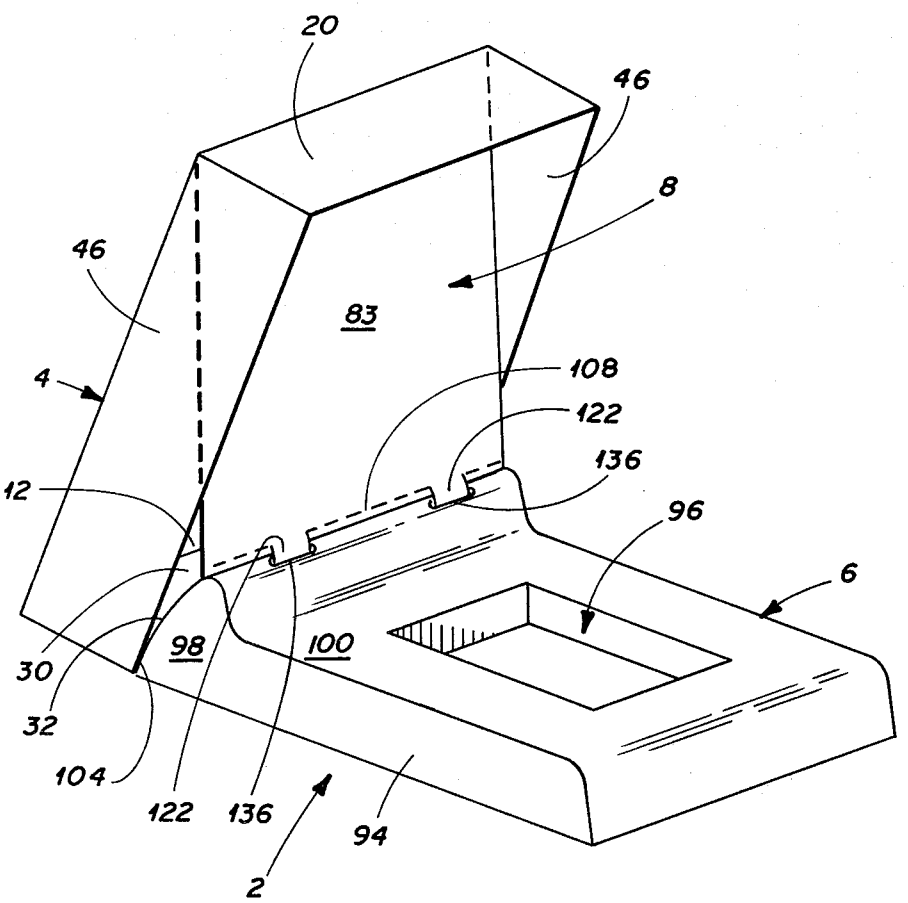
FIG. 6 is a perspective view of another embodiment of the present invention in its open position.

As shown in FIG. 1, a base assembly 6 is hingably attached and secured to cover means 4 and guide means 8. Referring to FIGS. 1 and 3, base assembly 6 comprises a base section 94 of a similar configuration to top panel 12 of cover means 4. The base section 94 may be raised as shown in FIGS. 1 and 3, and may comprise article holding apertures 96, as shown in FIGS. 1 and 6, article holding apertures 96 being of any suitable configuration and generally dependent upon the article to be held therein. Base section 94 also includes a raised, beveled section 98, preferably at one end of the base section 94. Beveled section 98 preferably includes a raised, arcuate path extending from a point along top planar surface 100 of the base section 94 upward in an arcuate manner to an apex point 102 and thereafter down in an arcuate manner to a bottom, end section 104 of base section 94.

Referring to FIG. 1, it is seen that inside back panel 32 of cover means 4 is hingably attached to raised, beveled section 98 of base section 94. Additionally, the area of guide means 8 defined by working score line 88 of guide means 8 and perforation 74 is fixedly attached, e.g., by any suitable means such as glue, to the uppermost part of raised, beveled section 98.

Figure 7:
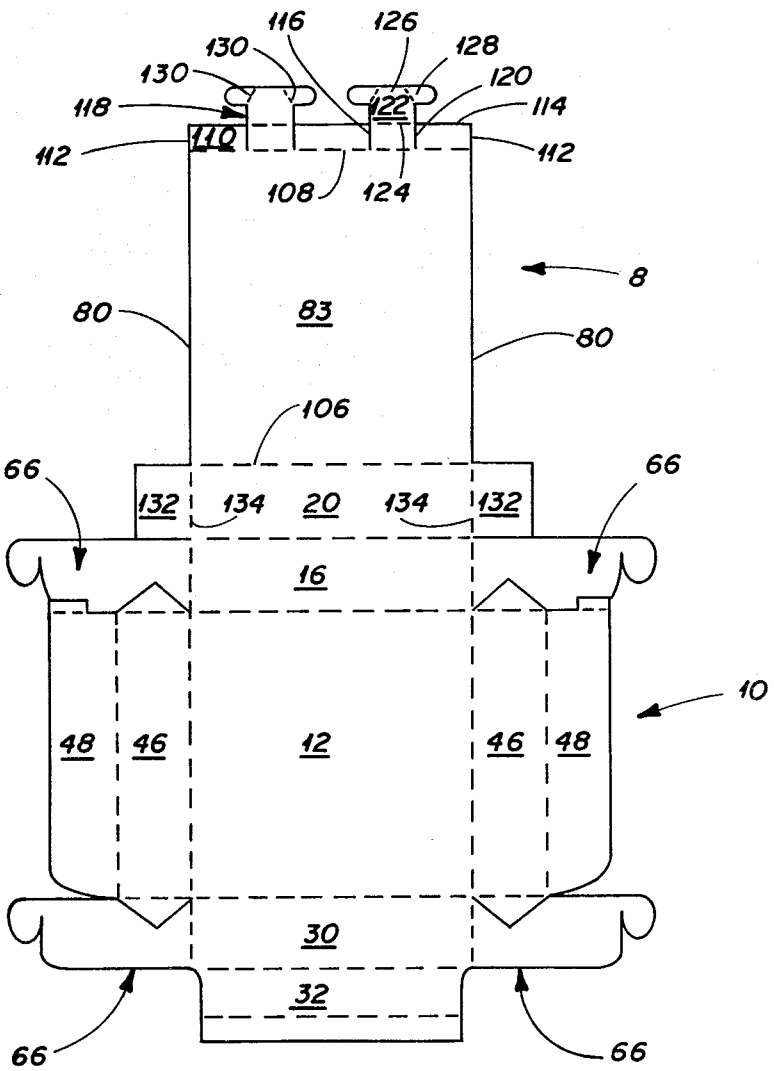
FIG. 7 is a top, plan view of the sheet blank of the embodiment of the present invention of FIG. 6.

Alternatively, as shown in FIGS. 6 and 7, guide means 8 may be integrally attached to inside front panel 20 on the side opposite working score line 22, hereinafter known as inside front panel working score line 106. Guide means 8 includes, as shown in FIG. 7, a main section 83 defined by working score line 106, side walls 80 and working score line 108 parallel and opposite to working score line 106, main section 83 thereby preferably being defined by a rectangular section. Integrally attached to main section 83 at working score line 108 is rectangular tab section 110 being defined by working score line 108, side walls 112 parallel and co-linear with side walls 80, and end wall 114 opposite to working score line 108. Additionally, rectangular tab section 110 comprises two spaced parallel spaces 116 therein, the boundaries of spaces 116 being parallel to side walls 112 and 80. Disposed within spaces 116 are securing tabs 118, each securing tab 118 comprising two parallel spaced walls 120, co-linear with the boundaries of spaces 116, and extending from working score line 108 to a point beyond end wall 114 of rectangular tab section 110. Additionally, an area 122 defined by parallel spaced walls 120 and working score line 108 includes a working score line 124 parallel to and co-linear with end walls 114 of rectangular tab section 110. Centrally and integrally attached to each area 122 at the free end thereof, e.g., at the free ends of parallel spaced walls 120, is tab section 126, preferably of a rectangular configuration, having its longest dimension centrally and integrally attached to the free end of area 122, the longest dimension of tab section 126 being of greater dimension than the distance between parallel side walls 120. In this manner, each tab section 126 comprises end tabs 128 which are diagonally scored at end tab working score lines 130.

Additionally, as shown in FIG. 7, inside front panel 20 includes locking tab sections 132 attached to inside front panel 20 at the free ends thereof and abutting slit-locking sections 66, tab sections 132 being attached to inside front panels 20 at a line, hereafter known as locking tab section working score lines 134.

Referring to FIGS. 6 and 7, it is seen that the alternate embodiment as shown in those Figures is assembled with base assembly 6 in substantially the same manner as the embodiment of FIG. 1. Thus, referring to FIG. 7, the blank section shown therein is assembled in the same manner as the blank section shown in FIG. 2 with the following differences. Locking tab sections 132 are folded at right angles to inside front panel 20 along working score line 134 such that tab sections 132 are secured and restrained within the folded side panel sections between outside side panel 46 and inside side panel 48.

Additionally, when inside front panel 20 is glued to outside front panel 16, main section 83 of guide means 8 is folded about working score line 106. In this manner, guide means 8 is integrally attached to cover means 4. At the opposite end of main section 83 of guide means 8, as shown in FIGS. 6 and 7, tab sections 126 of securing tab 118 secure the unattached end of guide means 8 to raised, beveled section 98 near apex point 102. This latter result is achieved by first folding end tabs 128 of tab sections 126 about end tab working score lines 130 such that the free end of tab sections 126 may be inserted within corresponding apertures 136 of base assembly 6. Upon inserting tab sections 126 within apertures 136, end tabs 128 tend to spring back toward their original position slightly, thus securing the free end of guide means 8 within base assembly 6.

At the opposite end of cover means 4, as shown in FIGS. 6 and 7, inside side panel 32 is folded about working score line 36 such that it may be secured to the base of raised, beveled section 98 by any suitable means, e.g., glue. In this manner, cover means 4 is hingably secured to base means 6.

Figure 4:
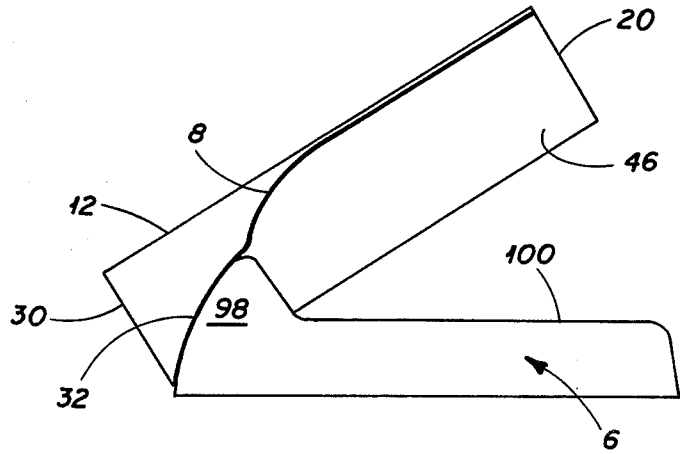
FIG. 4 is a side, cross-sectional view of the invention of FIG. 1 in a partially closed position.
Figure 5:
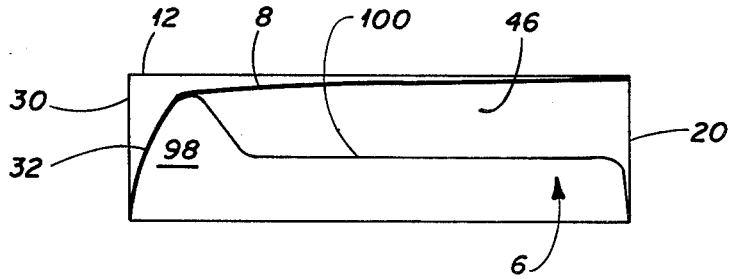
FIG. 5 is a side, cross-sectional view of the present invention of FIG. 1 in its closed position.

Referring to FIGS. 3–5, the operation of the embodiment of FIG. 1, and consequently the embodiment of FIG. 6, is shown in a series of action drawings. FIG. 3 discloses the present invention with the cover in open position. It is seen that guide means 8 is in a flat, tension-free position so as to retain cover means 4 in an open, stable configuration. If cover means 4 is closed slightly, thus forcing guide means 8 into a slightly arcuate configuration, the tension on guide means 8 will force cover means 4 into the stable, open position of FIG. 3.

As shown in FIG. 5, when cover means 4 is closed about base assembly 6, guide means 8 is in a substantially flat, tension-free position. This latter configuration results in the cover means 4 remaining closed about the base assembly 6. If cover means 4 is raised slightly, tension is exerted on guide means 8 such that guide means 8 will force cover means 4 into the tension-free, closed position of FIG. 5.

As shown in FIG. 4, cover means 4 is in an intermediate position between FIGS. 3 and 5, e.g., approximately at a 45° angle. In this position, guide means 8 is bent in an arcuate configuration such that through a range of intermediate positions, Guide means 8 will retain cover means 4 in any of those desired positions. Thus, it is seen that a unique cover carton is provided, wherein a guide means urges the cover means 4 towards a closed and open position and retains the cover means 4 in a plurality of partially opened positions when the cover means is at an appropriate angular position with respect to the base assembly 6.

It is to be understood that the invention is not limited to the illustrations described and shown herein, which are deemed to merely illustrative of the best mode of carrying out the invention, and which are suitable of modification of form, size, arrangement of parts, and details of operations. For example, the hinged cover carton 2 of the present invention may comprise a circular cover means 4 and a circular base assembly means 6 hingably attached to the cover means 4, hinged cover carton 2 having an appropriately shaped guide means 8 associated with the circular cover carton 2. The invention rather is intended to encompass all such modifications which are within the spirit and scope as defined by the claims.

What is claimed is:

1. A hinged cover carton comprising:

a cover means, said cover means comprising a top panel and a side wall integrally attached thereto, said side wall extending the entire perimeter of said top panel;

a base assembly comprising a base section having a raised, beveled area along a portion thereof, said base section being hingably attached to said side wall of said cover means; and a guide means attached along a portion thereof to said beveled area, and attached along an opposing portion thereof to the inside of said cover means, wherein said guide means is adapted to alternately urge said cover means towards a closed and opened position and retain said cover means in a plurality of partially opened positions when said cover means is at an appropriate angular position with respect to said base assembly.

2. The hinged cover carton of claim 1 wherein said top panel is of a rectangular configuration and said side wall comprises four panels at right angles to each other.

3. The hinged cover carton of claim 1 wherein said top wall and said side wall form an angle of 90° therebetween.

4. The hinged cover carton of claim 1 wherein said top wall is of a circular configuration and said side wall is of a circular configuration.

5. The hinged cover carton of claim 1 wherein said base section includes a substantially planar top surface, and a beveled area extending above said top surface.

6. The hinged cover carton of claim 1 wherein said cover means is hingably attached at a free end of said side wall to the lower end of said beveled area of said base section.

7. The hinged cover carton of claim 1 wherein said guide means is attached to said beveled area at an uppermost point thereof, and is hingably attached along an opposing area thereof to the inside of said cover means at a juncture of said side wall and said top panel.

8. A blank useful in the preparation of a hinged cover carton, said blank comprising:

a cover means, including a top panel and a side wall integrally attached to said top panel; and a guide means integrally attached to said side wall, said guide means adapted for attachment along a portion thereof to a base assembly of said carton, wherein said guide means is adapted to alternatively urge said cover means towards a closed and opened position when said cover means is attached to said base assembly and is at an appropriate angular position with respect thereto.

9. The hinged cover carton of claim 8 wherein said top panel is of a rectangular configuration and said side wall comprises side panels on opposite sides of said rectangular top panel, a front panel attached at a free end of said top panel, and a back panel attached to a side of said rectangular top panel opposite said front panel.

10. The hinged cover carton of claim 9 wherein said blank includes locking sections attached to opposing sides of said back panel and said front panel that are perpendicular to the line of attachment of said top panel to said back panel and front panel, respectively.

11. The hinged cover carton of claim 9 wherein said guide means is attached at one end thereof to said front panel.

12. The hinged cover carton of claim 11 wherein said guide means includes securing tabs on the side thereof opposite the side of attachment of said guide means to said front panel.

13. The hinged cover carton of claim 9 wherein said guide means is attached to said back panel.

* * * * *